United States Patent [19]

Petersen et al.

[11] Patent Number: 4,472,133

[45] Date of Patent: Sep. 18, 1984

[54] METHOD OF OPERATING A VAPOR BURNER FOR LIQUID FUEL AND VAPOR BURNER AND CONTROL DEVICE FOR PERFORMING SAID METHOD

[75] Inventors: Jorgen H. Petersen; Peter J. M. Clausen; Hilmar O. Rasmussen, all of Nordborg, Denmark

[73] Assignee: Danfoss A/S, Nordborg, Denmark

[21] Appl. No.: 545,490

[22] Filed: Oct. 26, 1983

[30] Foreign Application Priority Data

Nov. 24, 1982 [DE] Fed. Rep. of Germany ..... 3243395

[51] Int. Cl.[3] ..... F23D 11/44

[52] U.S. Cl. ..... 431/3; 431/32; 431/121; 431/208

[58] Field of Search ..... 431/208, 121, 32, 3

[56] References Cited

U.S. PATENT DOCUMENTS 4,396,372 8/1983 Matumoto et al. ..... 431/208
4,408,984 10/1983 Forster ..... 431/208

FOREIGN PATENT DOCUMENTS 295827 3/1954 Switzerland ..... 431/208

*Primary Examiner*—Carroll B. Dority, Jr.
*Attorney, Agent, or Firm*—Wayne B. Easton

[57] ABSTRACT

A self cleaning vapor burner for liquid fuel in communication with a combustion chamber. The burner includes an electrically heated evaporating tube. The supply of liquid fuel is periodically interrupted to the evaporating tube wherein the tube is heated to a predetermined cleaning temperature to effect deposits on the evaporating tube wall to ash.

38 Claims, 4 Drawing Figures

METHOD OF OPERATING A VAPOR BURNER FOR LIQUID FUEL AND VAPOR BURNER AND CONTROL DEVICE FOR PERFORMING SAID METHOD

The invention relates to a method of operating a vapour burner for liquid fuel which is fed to an evaporating chamber, is there heated up to vaporisation and then delivered substantially as a gas to a combustion chamber, and to a vapour burner and a control device for performing the method.

In a known vapour burner of this kind (VDI Reports No. 423, 1981, pages 175–180), the evaporating chamber consists of a multiplicity of passages of small cross-section accommodated in a hollow cylinder which carries an electric heating coil at the outer periphery. The gaseous fuel leaves the hollow cylinder through holes at the circumference, is there mixed with air of combustion supplied as an annular jet and then forms the flame in a combustion chamber enclosed by the wall of a flame tube. Recirculation takes place through the interior of the hollow cylinder to the position where the air of combustion is supplied. A control device switches off the heating apparatus after a stable operating point has been reached. If, in this consturction, residues are formed in the evaporating chamber, particularly oil coke, the passages of small cross-section can become blocked.

The invention is based on the problem of providing a method of the aforementioned kind with which automatic cleansing of the evaporating chamber is possible.

This problem is solved according to the invention in that the evaporating chamber is, in a cleansing phase taking place during interruption of fuel supply, heated to a cleansing temperature at which deposits on the chamber wall burn to ash which is blown out into the combustion chamber.

By heating the evaporating chamber without the supply of fuel and without the dissipation of heat associated therewith, it is easy to produce cleansing temperatures at which the deposits, which are predominantly of carbon, burn to ash. The ash can then be relatively easily blown out almost completely. By means of this self-cleansing, the walls of the evaporating chamber are so clean that, during subsequent vapour operation, there is a very good transfer of heat to the fuel to be vaporized. By reason of this cleansing, it is also possible to burn inferior fuels which are heavily soiled and have a high viscosity and/or high density.

Preferably, the ash is blown out by the gas developed during the next supply of fuel. No special measures need therefore be taken for this blowing out step.

Switching-on of such a cleansing phase preferably takes place automatically. For example, each switching-on phase can be preceded by a cleansing phase or each switching-off phase followed by a cleansing phase. It is also possible for the cleansing phase to be introduced depending on a signal which characterises the operating periods, i.e. for example after a certain number of operating hours, after a certain number of switching-on steps or after reaching a particular amount of the liquid fuel supplied. The cleansing phase can also be introduced depending on a signal which is indicative of the size of the deposit, e.g. on exceeding a certain temperature at the wall of the evaporating chamber at which there is an unusual temperature rise in the evaporating chamber during starting, at an excessively high electric conductivity along the wall of the evaporating chamber caused by the deposits, or upon particular changes in the flame or in the exhaust gas.

It is particularly advisable if the cleansing phase, followed by a switching-on phase, is introduced depending on an error represented by one or more ignition or flame failures. In many cases, ignition failure during starting or flame blow-off during operation is caused by deposits and therefore a switching-on phase will restore normal operation after the cleansing phase. For this reason, automatic switching-off hitherto encountered with such errors and necessitating manual restarting can be minimised.

Automatic switching-off of the burner should, however, occur if a predetermined number of cleansing and switching-on phases has been conducted and the error is still present. This predetermined number can be 1 or higher. Switching-off is therefore restricted to cases in which the cleansing phase has failed to provide a remedy.

Preferably, the cleansing temperature is between 700° and 1400° C. In this temperature range, it is fairly certain that all residues on the wall of the evaporating chamber will burn.

Burning to form ash makes the presence of oxygen a prerequisite. In most cases, the oxygen in the air present in the evaporating chamber during standstill of the burner will be sufficient, the cleansing phase possibly being repeated several times. In some cases, however, it is advisable to supply the evaporating chamber during the cleansing phase with an amount of air which is a small fraction of the total air of combustion. This amount of air should, however, be so small that it will withdrawn practically no heat from the fluid to be vaporised and the walls of the chamber during normal operation and it will blow no unevaporated liquid out of the evaporating chamber. In practice, amounts of air less than 1.9%, preferably in the order of 0.2 to 0.5% of the maximum amount of air of combustion have proved to be sufficient to burn the coating to ash in a very few minutes in almost completely blocked evaporating chambers. This air also increases the reliability of ignition because the air in the tube increases the pilot flame as well as its duration before it has suffocated in the subsequent fuel gas. Particularly in the case of low outputs, the supply of secondary cleansing air also serves as a kind of carrier gas whereby an adequate speed of gas can be maintained at the mouth of the evaporating tube.

In a preferred embodiment, one zone near the mouth of the evaporating chamber is heated up to annealing temperature at least upon commencement of the operating phase. Since the heating apparatus is already designed so that the coating can burn to ash, one can achieve the annealing temperature without additional expenditure. As a result, on switching the burner on, the first gaseous fuel formed produces with the air in the evaporating chamber an ignitable mixture which is ignited at the red-hot zone, whereupon the flame so formed is pushed outwardly into the combustion chamber by the subsequently developed fuel gas. This leads to gentle starting without pulsations, completely combustion without the formation of soot, i.e. with a blue transparent flame, taking place from commencement of the starting phase.

A vapour burner for performing the previously described method and comprising an evaporating chamber which is heatable by an electric heating apparatus and has at least one outlet aperture opening into a combustion chamber, and a passage system for supplying air of combustion to the combustion chamber, is characterised in that the evaporating chamber is formed substantially by an evaporating tube extending centrally to the passage system and that the outlet cross-section amounts to at least 5% of the internal cross-section of the evaporating tube.

The evaporating tube has a large cross-section in comparison with a plurality of parallel evaporating passages. The outlet cross-section is also correspondingly large and in any case much larger than the nozzles conventional for atomising burners. In addition, since the at least one outlet aperture opens directly into the combustion chamber, the ash can be blown out without difficulty. Blockage of the apertures is unlikely.

It is advisable for the cross-section of each outlet aperture to be larger than 1 $mm^2$, preferably at least 3 $mm^2$. The ash will be blown out very rapidly.

In one embodiment, the evaporating tube is open at the end adjacent to the burner. The ash can then be blown out without any resistance.

In another embodiment, the end of the evaporating tube adjacent to the burner is provided with an end plate having at least one outlet aperture of a cross-section of 5 to 40% of the internal cross-section of the evaporating tube. The end plate will only slightly impede the blowingout of the ash but will form a barrier to as yet unvaporised fuel droplets which therefore remain in place for a longer time for complete evaporation.

In a further embodiment, the evaporating tube is provided with an end plate which at least partially closes the end adjacent to the combustion chamber and has outlet apertures in the circumferential wall. The outlet apertures in the circumferential wall permit the ash to be blown out fully taking account of its own weight. In addition, the discharged gaseous fuel is uniformly mixed into the supplied air of combustion.

The cleansing temperature can be achieved with the aid of an electric heating apparatus which surrounds the outside of the evaporating tube. It is particularly advantageous, however, if the evaporating tube is of electrically conductive material and terminals are provided for the supply of current. This enables the cleansing temperature to be reached particularly quickly. The reason for this is on the one hand that the heat is transmitted directly from the heating apparatus, namely the evaporating tube, to the deposits of coke and on the other hand that the coke deposit is itself conductive and, by abutting the conductive evaporating tube, is traversed by a heating current.

It is particularly favorable if the material of the evaporating tube has a higher electrical resistance than coke. The predominant part of the heating current will then flow directly through the deposit and heat same rapidly up to the cleansing temperature.

In particular, the evaporating tube may be of silicon carbide hermetically sealed by saturating silicon. Silicon carbide on the one hand withstands the high temperatures and on the other hand possesses the required electric conductivity. The evaporating tube of silicon carbide can also be hermetically sealed if it carries a coating of silicon oxynitride. This coating also increases the life because it is resistant to oxydising and reducing atmospheres. In addition, it possesses electric insulating properties.

The terminals are desirably soldered on with the aid of a silicon solder. Such terminals are resistant despite the high temperatures.

In one embodiment, the evaporating tube is surrounded by a thermal insulating layer but the terminals are located in a space which is free from insulation. In this way, the evaporating tube can rapidly reach the cleansing temperature but the terminals are subjected to a certain cooling effect.

In one construction, the evaporating tube carries at the end adjacent to the combustion chamber an external ring of electrically conductive material, a terminal being applied near its outer circumference. This terminal is spaced from the evaporating tube and disposed near the passage system. It is therefore subjected to low temperature stress.

The ring may also comprise a projection and itself serve as an annealing head, for example in that thinner wall thicknesses in the vicinity of the projection lead to more intensive heating.

In particular, the evaporating chamber may be connected to the passage system by at least one throttle aperture. A limited amount of secondary air will flow through this throttle aperture into the vicinity of the fuel supply tube into the evaporating chamber and will facilitate cleansing.

A particularly simple embodiment is obtained if the evaporating tube consists of a first tube and a second tube of smaller diameter which engages over the end of the first tube remote from the combustion chamber, at least one supporting ring between the tubes having throttle apertures connected on the inlet side to the passage system. This readily makes it possible to introduce the smallest amounts of air of combustion into the evaporating tube. In addition, the oil supply tube having a still smaller diameter can be more easily inserted in the rear end of the evaporating tube.

Additional advantages are obtained if the evaporating tube is surrounded by an electrically conductive cover tube which is concentrically spaced therefrom and electrically connected thereto at the end, both terminals being applied to the end of the evaporating tube or cover tube remote from the combustion chamber. In this way, both terminals will be disposed in a cooler zone.

It is also possible for the annular gap between the two tubes to serve as an air passage connected to the passage system: by an aperture in the cover tube at the end adjacent to the combustion chamber and connected to the evaporating chamber by an aperture in the evaporating tube at the opposite end. In this way, there is preheating of air reaching the evaporating chamber during operation or during the cleansing phase.

To achieve electric insulation between the evaporating tube and the fuel supply system, it is also favourable for the evaporating tube to be connected to a fuel supply tube by a tubular holder and additional connecting means and for the holder and/or connecting means to be of electrically insulating material. The connecting means can, for example, comprise glass solder. The fuel supply tube which is generally of metal is therefore electrically insulated from the evaporating tube.

A control device for performing the previously described method comprises a first outlet to control the fuel supply to the vapour burner, a second outlet to control the output of the electric heating apparatus and possibly a third outlet to control the supply of air, inlets for parameters influencing the operation, and a programme circuit for controlling the outlets at the proper times. According to the invention, this control device is characterised in that the programme circuit is so designed that the second outlet delivers a switching signal by reason of which the heating apparatus is supplied with electric energy sufficient for burning deposits in the evaporating chamber.

This construction of the control device, the expense for the correct sequence of the cleansing phase is reduced to a minimum. This is because, by utilising data already provided in the control device, the cleansing phase is developed merely in relation to the occurrence of a cleansing signal.

The programme circuit can be designed so that, with a time overlap with the switching signal, the third outlet produces a releasing signal by reason of which the vapour burner is supplied with secondary air. In this way, cleansing air is also supplied automatically to improve the cleansing effect.

There are numerous different possibilities for producing the cleansing signal. If the programme circuit is designed for a switching-on plane which sets the vapour burner into operation at the correct time, the cleansing signal can be produced by the programme circuit itself prior to commencing the switching-on phase. If the programme circuit is designed for a switching-off phase which makes the vapour burner inoperative at the correct time, the cleansing signal can be produced by the programme circuit itself after completion of the switching-off phase. To deliver the cleansing signal one can also employ a measuring apparatus which characterises the operating periods of the vapour burner. Another possibility resides in producing the cleansing signal by a measuring apparatus which detects the amount of deposit in the evaporating chamber either directly or indirectly.

In a control device having a safety circuit which delivers an error signal on the occurrence of an error represented by one or more ignition or flame failures, it is advisable for the programme circuit to comprise a control circuit which, on the occurrence of the error signal, introduces the production of the blocking signal and the switching signal and thereby causes the cleansing phase to take place and subsequently introduces a switching-on phase while the blocking signal is omitted. Frequently, the cleansing step will be sufficient to remove the error. If the control device comprises a switching-off apparatus initiated by a switching-off signal, the control circuit should deliver the switching-off signal when a predetermined number of cleansing and switching-on phases has been conducted and the error signal is present. It is only if the cleansing phases fail to remove the error that switching-off will take place-automatically, switching-on being prevented by a manually releasably lock.

Preferred examples of the invention will now be described in more detail with reference to the drawing, wherein.

Figure 1:
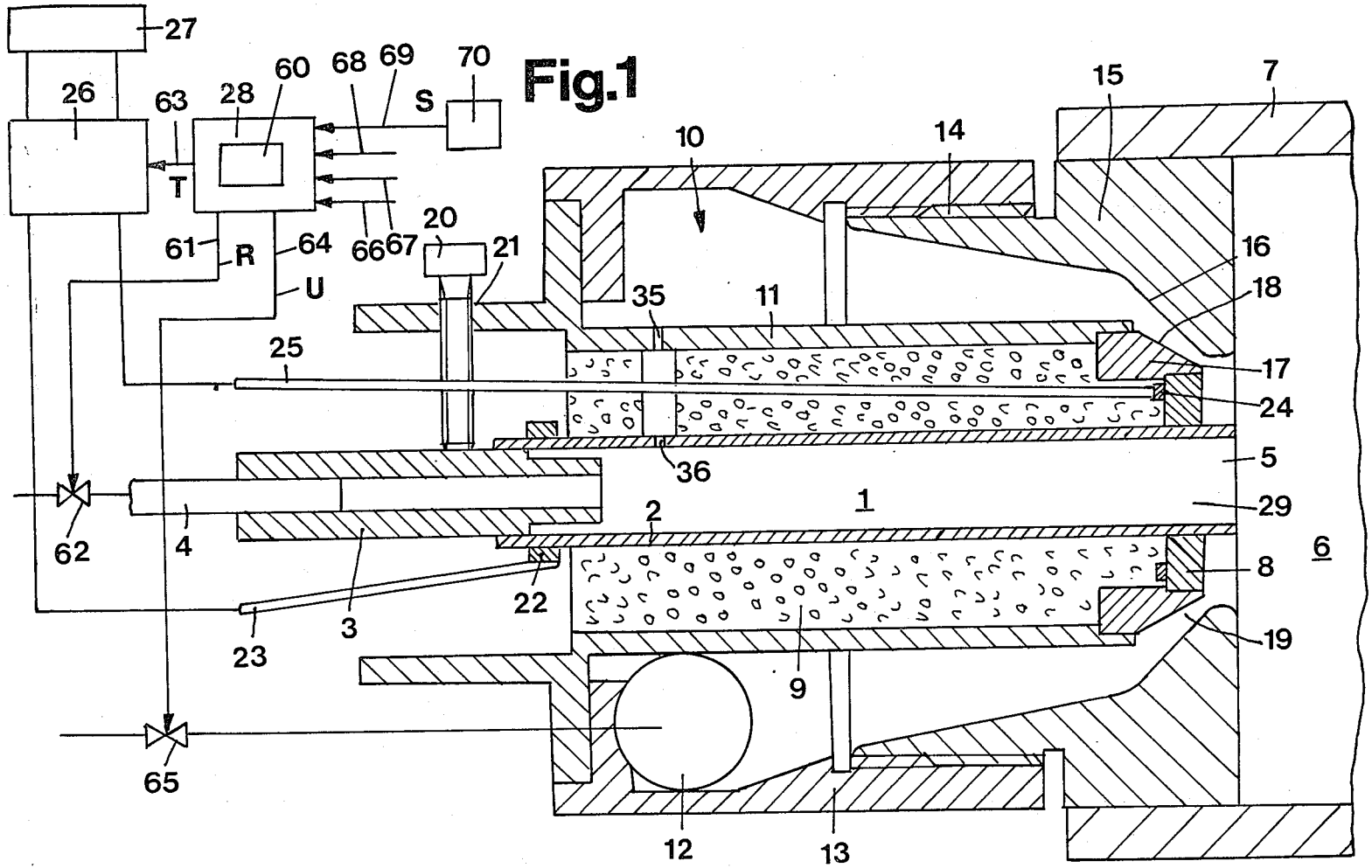
FIG. 1 is a longitudinal section through a first embodiment of a vapour burner according to the invention.

In the FIG. 1 embodiment, an evaporating chamber 1 is formed substantially by an evaporating tube 2 connected at the rear by a tubular holder 3 to a fuel supply tube 4, for example a standard capillary tube of stainless steel. The opposite end forms a large outlet aperture 5 and is directed to a combustion chamber 6 surrounded by a hollow cylindrical burner tube 7. The end 5 of the evaporator tube 2 carries a ring 8 on the outside and is surrounded over practically its entire length by thermal insulation 9. A passage system 10 for supplying air of combustion is formed between a housing 11 surrounding the thermal insulation 9 and a cover 13 provided with a tangential supply connector 12. By means of a screwthread 14, a burner head 15 is secured to this cover and carries a conical surface 16 at the front. The housing 11 is connected to the outer ring 8 by a connecting ring 17 having an outer conical surface 18. The two conical surfaces define a conical annular gap 19 for the outlet of air, its width being variable by turning the burner head 15. Cleansing air from the passage system 10 is led to the evaporating chamber 1 through a throttle aperture 35 in the housing 11 and a throttle aperture 36 in the evaporating tube 2, the apertures being interconnected through a free space in the thermal insulation 9.

Three screws 20 (only one is visible) are screwed into tapped holes 21 of housing 11 and secure the position of the holder 3 and thus the evaporating tube 2.

The evaporating tube 2 and the outer ring 8 consists substantially of silicon carbide hermetically sealed by saturating with silicon. This material is also electrically conductive. Instead, or in addition, the silicon carbide may be coated with a layer of silicon oxynitride. At the rear end, there is a connecting ring 22 for which a lead 23 extends. On the outside of the ring 8 there is a current terminal ring 24 from which a lead 25 extends. The connections are produced by means of a silicon solder.

The holder 3 and connecting ring 17 consist of an electrically insulating and thermally insulating material, for example ceramic material such as magnesium silicate, cordierite or the like. The holder 3 is hermetically inserted in the evaporating tube 2. The supply conduit 4 is also gas-tight in the holder 3. Both can be achieved by means of a glass solder.

The thermal insulation 9 can for example be of ceramic fibres, aluminium oxide, silicon dioxide etc.

The two leads 23 and 25 are connected to a switching apparatus 26 which, in turn, is energised from a voltage source 27, e.g. a normal A.C. mains supply. The switching apparatus 26 is controlled by a control device 28 constructed on the principle of a known automatic firing device and comprisisng a programme circuit 60. A first outlet 61 controls a valve 62 for the supply of fuel by means of a blocking signal R. By means of a switching signal T, a second outlet 63 controls the power of the electric heating apparatus with the aid of the switching apparatus 26. By means of a signal U, a third outlet controls a valve 65 for the supply of air to the passage system 10. By way of inlets 66, 67 and 68, signals from boiler thermostats, a flame monitor and the like are supplied in known manner. One of the inlets 69 may be connected to a measuring apparatus 70 which delivers a cleansing signal S for introducing a cleansing phase when the coating in the evaporating chamber 1 has exceeded a predetermined thickness. The cleansing signal S can, however, be derived from data that is in any case provided within the control device 28. For example, it is produced before commencement of each switching-on phase, upon completion of each switching-off phase, after a certain number of operating periods of the installation, upon the occurrence of an error signal appearing on ignition or flame failure, or the like.

As usual, the control device 28 is designed so that the switching-on phase is repeated one or more times if an attempt at ignition is without success or the flame blows off during operation. Thereafter, there is final switching-off and restarting will be possible manually only. In this case it is particularly favourable if one or more switching-on phases are preceded by a cleansing phase which might possibly eliminate the cause of the error and make switching-off unnecessary.

The cleansing phase is conducted as follows:

The leads 23 and 25 are energised without supplying fuel through the conduit 4. The evaporating tube 2 is thereby heated to a temperature of 700° to 1400° C. Any coke deposits adhering to the inside will burn to ash with the aid of oxygen from the cleansing air led to the evaporating tube. This ash is blown with the cleansing air through the outlet aperture 5 into the combustion chamber 6.

If, while maintaining the switching signal T and thus the heating, the evaporating tube 2 is cooled by the entry of liquid fuel or, if on a change in the switching signal T, the current through the evaporating tube 2 is reduced, its temperature will drop. However, in the vicinity of the outlet aperture 5, namely within the outer ring 8, there will remain an annular glowing zone 29. When the supply of fuel is switched on and the first drop of fuel evaporates in the evaporator tube 2, a combustible mixture is formed in conjunction with the air contained in the tube and this mixture is ignited at the glowing zone 29 and pushed out into the combustion chamber 6 by the following vaporised fuel. whereupon this following gas forms a combustible mixture with the air of combustion supplied through the passage system 10 and is ignited by the flame originally produced at the glowing zone. Subsequently, the amount of electric energy supplied to the evaporating tube 2 can be further reduced because a glowing zone 29 is no longer important to achieve stoichiometric combustion.

Figure 2:
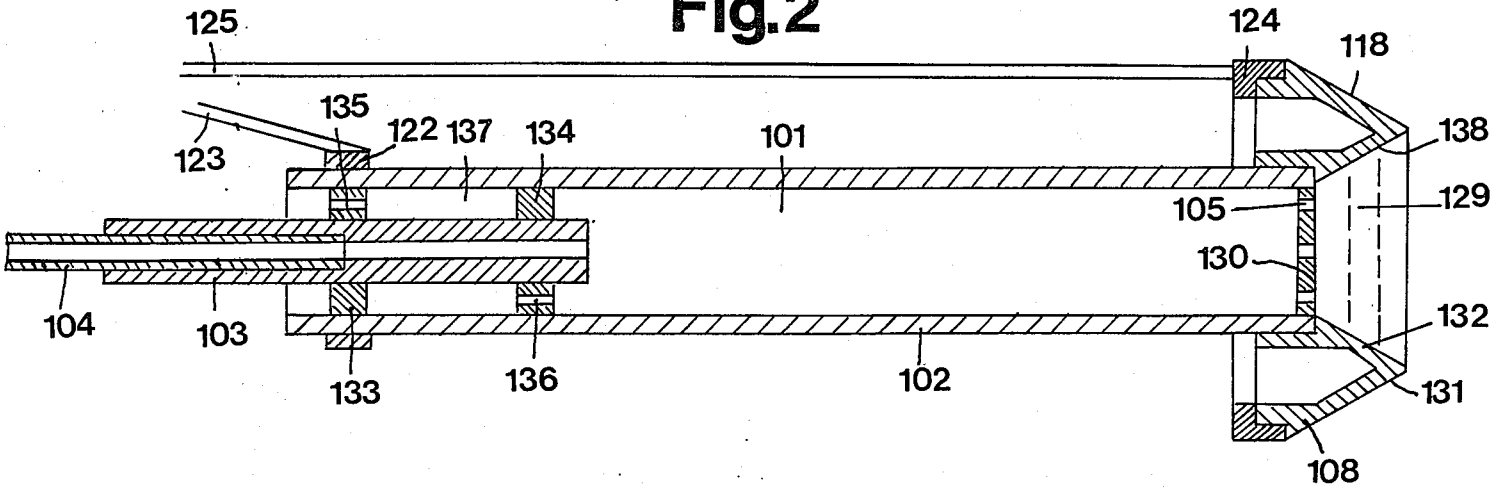
FIG. 2 is a longitudinal section through a modified vapour burner with associated components.

In the embodiment of FIG. 2, corresponding integers are provided with the same reference numerals increased by 100. Parts of the entire construction which have been omitted will have a form similar to that in FIG. 1.

The evaporating tube 102 is provided at the front end with an end plate 130 having a plurality of outlet apertures 105. They lie at the centre and on a concentric circle. An outer ring 108 that is placed over comprises a lug 131 with a thinner wall zone 132. When current flows through the evaporating tube 102 and this outer ring 108, the wall zone 132 becomes hotter to create a glowing zone 129 at this position.

At the rear end, the holder is in the form of a tube 103 held in the evaporating tube 102 by way of two supporting rings 133 and 134. The supporting rings comprise throttle apertures 135 or 136 which are offset from each other. An intermediate space 137 is provided between the two supporting rings. The rear end of the evaporating tube 102 is connected to the passage system 10 (here not shown). Consequently, a small amount of secondary air enters the evaporating chamber 100 from the passage system. However, the discharge of gaseous fuel is prevented because the supporting rings 133 and 134 form a labyrinth seal. Desired jet forms for the gaseous fuel are produced by the outlet apertures 105. The conical face 138 of ring 108 has a somewhat larger cone angle than the fuel jet so that, as a result of recirculation, air of combustion is additionally led to the glowing zone 129. The outer conical surface 118 serves to guide air.

Figure 3:
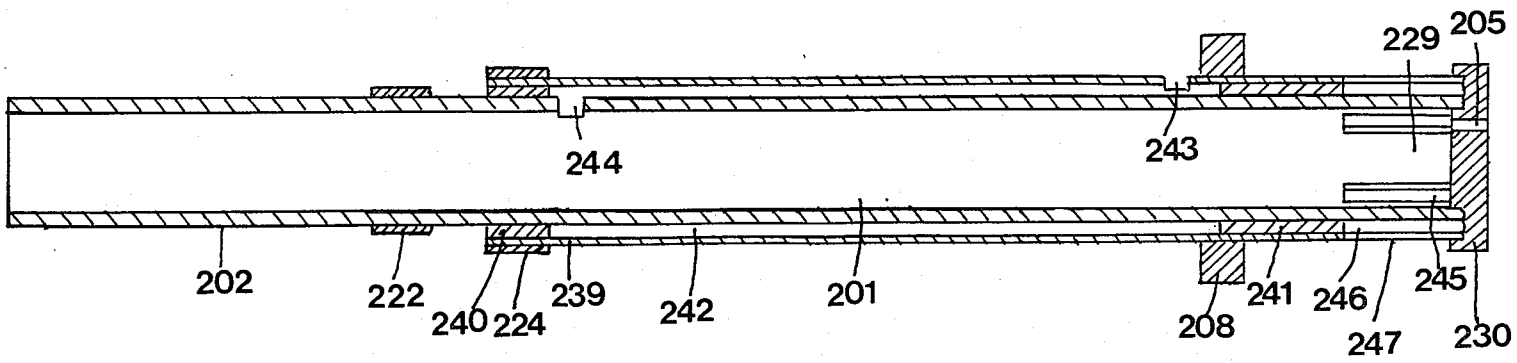
FIG. 3 is a longitudinal section through a further vapour burner with associated components.

In the FIG. 3 embodiment, the reference numerals are increased by 200 relatively to FIG. 1 and 100 relatively to FIG. 2. The rear connection of the evaporating tube 202 is not shown in detail. The evaporating tube 202 is surrounded at a spacing by a concentric cover tube 239 supported on the evaporating tube by a rear supporting ring 240 and a front supporting ring 241. The cover tube carries the outer ring 208 with which the arrangement can be secured at the front. The electric connection 224 is applied to the rear end of the cover tube. The space 242 between the two tubes serves as an air passage having at the front of the cover tube an aperture 243 which leads to the passage system 10 and at the rear an aperture 244 in the evaporating tube 202 leading to the evaporating chamber 201. Consequently, secondary air heated while flowing through the passage 242 can be introduced in the evaporating chamber. At the front end there is an end plate 230 with outlet apertures 205 but it engages over the end faces of the evaporating tube 202 and cover tube 239. The evaporating tube 202, the end plate 230 and the cover tube 239 are of silicon carbide. Consequently, there is a closed electric circuit between the terminals 222 and 224, the evaporating tube being heated the most because it is designed to have the largest electric resistance. At the front end, the evaporating tube comprises further outlet apertures 245 at the periphery in communication with corresponding circumferential apertures 247 in the cover tube by way of an annular space 246. It is through these circumferential apertures that ash can be particularly readily blown out with the conventional horizontal arrangement of the evaporating tube 202. In addition, the circumferential apertures 245 and 247 achieve cross-sectional reductions in the evaporating tube 202 and in the cover tube 239 at which there is more intensive heating to form a glow zone 229.

Figure 4:
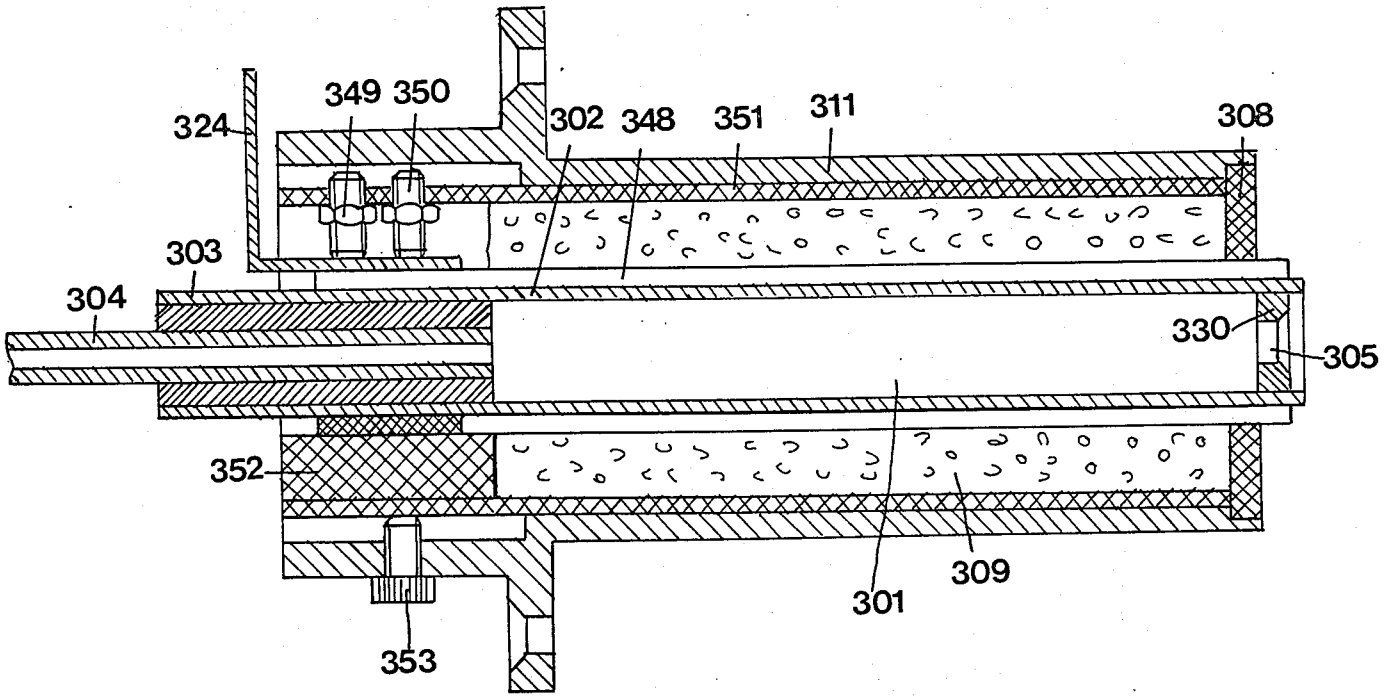
FIG. 4 is a longitudinal section through a still further embodiment.

In the embodiment of FIG. 4, corresponding parts are designated with reference numerals increased by 300 with respect to FIG. 1 or 200 with respect to FIG. 2. The evaporating tube 302 which may be of electrically insulating material has an end wall 330 at the front with a single central outlet aperture 305. It is surrounded by a heating resistor 348 such as of silicon carbide, for example in the form of a tube slotted once over its entire length and elsewhere several times from both ends over the larger part of the length. Of the terminals applied to the separated ends, only the angular terminal 324 is illustrated. It is pressed into the heating resistor 348 by screws 349 and 350. The screws are supported against an insulating tube 351 which surrounds the thermal insulation 309. A spacer sleeve 352 of insulating material hollowed out in the region of the terminals serves to centre the evaporating tube and is loaded by screws 353.

This indirect heating can again achieve the cleansing temperature or glow temperature in the vicinity of the front end of the evaporating tube 302. Instead of the slotted tube one can also employ a heater of resistance wire wound into single or multi-lead helices. By progressively increasing the helical leads, it is also possible to achieve locally differently strong heating.

In all cases, very low pump pressures will suffice for conveying the fuel into the evaporating tube, for example in the order of 0.1 bar to a maximum of 0.5 bar. The capacity of the burner can be varied approximately in the ratio 1:10, the fuel and air of combustion being adjusted substantially in the same ratio with respect to each other. The terminals may not only be soldered but can also be molten or sintered on.

We claim:

1. A method of operating a vapor burner system of the type comprising an evaporator tube forming an evaporating chamber, a fuel supply tube at the inlet end of said evaporating chamber and a combustion chamber at the outlet of said evaporating chamber, air passage means for supplying combustion air to said combustion chamber through said evaporating tube, control means for supplying liquid fuel to said fuel supply tube; said method comprising the steps of interrupting the flow of fuel to said supply tube for a period of time, heating said evaporating tube to predetermined cleaning temperature during said period of time to effect a cleansing operation by the burning of the deposits on the evaporating tube wall to ash, and blowing said ash into said combustion chamber.

2. A method according to claim 1 wherein said ash is blown out by the gas developing during the next supply of fuel.

3. A method according to claim 1 including a switching-on phase preceded by a cleansing phase.

4. A method according to claim 1 including a switching-off phase followed by a cleansing phase.

5. A method according to claim 1 wherein said cleansing operation is introduced depending on a signal which is indicative of the operating periods.

6. A method according to claim 1 wherein said cleansing operation is introduced depending on a signal characterising the amount of deposits.

7. A method according to claim 1 wherein said cleansing operation follows a switching-on phase introduced depending on an error represented by one or more ignition or flame failures.

8. A method according to claim 7 wherein a switching-off takes place automatically when a predetermined number of cleansing and switching-on phases has taken place and the error is still present.

9. A method according to claim 1 wherein said cleansing temperature is between 700° and 1400° C.

10. A method according to claim 1 wherein said evaporating chamber is supplied during said cleansing phase with an amount of air which is a fraction of the total air of combustion.

11. A method according to claim 10 wherein said fraction is less than 1.9%.

12. A method according to claim 1 wherein a zone near the mouth of said evaporating chamber is heated to annealing temperature at least on commencement of said operating phase.

13. A self-cleaning vapour burner for a liquid fuel, comprising, an evaporating tube forming an avaporating chamber, a fuel supply tube at the inlet end of said evaporating tube, a combustion chamber at the outlet of said evaporating tube, said evaporating tube outlet being at least 5% of the internal cross section of said evaporating tube, air passage means for supplying combustion air to said combustion chamber through said evaporating tube, control means for selectively supplying liquid fuel to said fuel supply tube so that the supply of fuel may be interrupted for a period of time to allow cleaning of said evaporating tube, electrical means for heating said evaporating tube to a predetermined cleaning temperature during said period of time to effect burning of the deposits on the evaporating tube wall to ash which is blown into the combustion chamber.

14. A self cleaning vapor burner according to claim 13 wherein said evaporating tube outlet is an aperture is on the order of 3 $mm^2$.

15. A self cleaning vapour burner according to claim 14 wherein said evaporating tube is open at its end adjacent said combustion chamber.

16. A self cleaning vapour burner according to claim 14 including an end plate for said evaporating tube adjacent said combustion chamber, said end plate having at least one aperture having a cross section which is 5 to 40% of the internal cross section of said evaporating tube.

17. A self cleaning vapour burner according to claim 14 including an end plate for said evaporating tube adjacent said combustion chamber which at least partially closes said tube, and apertures in said tube adjacent said combustion chamber providing fluid communication between said tube and said combustion chamber.

18. A self cleaning vapour burner according to claim 13 wherein said evaporating tube is of electrically conductive material and terminals on said tube to allow a current to flow through substantially the entire length of said tube.

19. A self cleaning vapour burner according to claim 18 wherein the material of said evaporating tube has a higher electrical resistance than coke.

20. A self cleaning vapour burner according to claim 18 wherein said material is silicon carbide hermetically sealed by saturation with silicon.

21. A self cleaning vapour burner according to claim 18 wherein said material is silicon carbide and carries a covering of silicon oxynitride.

22. A self cleaning vapour burner according to claim 18 wherein said terminals are soldered on with the aid of a silicon solder.

23. A self cleaning vapour burner according to claim 18 wherein said tube is surrounded by a heat insulating layer, said terminals being located in a space which is free from said insulating layer.

24. A self cleaning vapour burner according to claim 18 including at the end of the evaporating tube adjacent said combustion chamber an outer ring of electrically conductive material with a terminal applied near its outer periphery.

25. A self cleaning vapour burner according to claim 24 wherein said ring has a projection which serves as an annealing head.

26. A self cleaning vapour burner according to claim 13 wherein said evaporating chamber is connected to said air passage means via at least one throttle aperture in said evaporating tube.

27. A self cleaning vapour burner according to claim 13 including a second tube inside said evaporating tube remote from said combustion chamber, at least one supporting ring being between said tubes having throttle apertures connected on said inlet side to said air passage means.

28. A self cleaning vapour burner according to claim 18 including a concentric electrically conductive cover tube surrounding said evaporating tube in spaced relation thereto, said cover tube being electrically connected to said evaporating tube so that both said terminals are applied to the ends of said evaporating tube and said cover tube remote from said combustion chamber.

29. A self cleaning vapour burner according to claim 28 wherein an annular gap between said two tubes serves as an air passage connected by an aperture in said cover tube at the end thereof adjacent said combustion chamber to said air passage means and by an aperture in said evaporating tube at the end thereof opposite said combustion.

30. A self cleaning vapour burner according to claim 18 wherein said evaporating tube is connected to said fuel supply tube by a tubular holder, said holder being of an electrically insulating material.

31. A self cleaning vapour burner according to claim 13 wherein said control means includes a control device having a first outlet to control the fuel supply to said fuel supply tube, a second outlet to control the output of the electric heating apparatus for said evaporating tube, a third outlet for controlling the air supply to said combustion chamber, a programme circuit for operating the said outlets at the correct times, said programme circuit producing a blocking signal (R) at said first outlet and on the occurrence of an input cleansing signal (S) said second outlet delivers a switching signal (T) by reason of which said evaporating tube is supplied with electric energy sufficient for burning deposits on the inner wall of said evaporating tube.

32. A self cleaning vapour burner according to claim 31 wherein said programme circuit operates so that during a time overlapping with the switching signal (T) said third outlet delivers a release signal to effect supplying secondary air to said evaporating chamber.

33. A self cleaning vapour burner according to claim 31 wherein said programme circuit for the correct time sequence has a switching-on phase which sets said vapour burner in operation and produces said cleansing signal (S) before commencement of said switching-on phase.

34. A self cleaning vapour burner according to claim 31 wherein said programme circuit (60) for the correct time sequence has a switching-off phase which renders said vapour burner inoperative and produces said cleansing signal (S) after expiry of said switching-off phase.

35. A self cleaning vapour burner according to claim 31 wherein said control device has measuring means which characterises said operating periods of said vapour burner and delivers said cleansing signal (S).

36. A self cleaning vapour burner according to claim 31 wherein said control device has measuring means which detects the amount of deposit in said evaporating chamber and delivers said cleansing signal (S).

37. A self cleaning vapour burner according to claim 31 wherein said control device includes a safety circuit which delivers an error signal on the occurrence of an error represented by one or more ignition or flame failures, said programme circuit on the occurrence of an error signal causes the production of said blocking signal (R) and said switching signal (T) to initiate said cleansing phase, said safety circuit subsequently introduces said switching-on phase with said blocking signal omitted.

38. A self cleaning vapour burner according to claim 37 including a switching-off apparatus initiated by a switching-off signal, said control circuit delivering said switching-off signal when a predetermined number of cleansing and switching-on phases has been carried out and said error signal is present.

* * * * *